US010749274B2

(12) United States Patent
Oh et al.

(10) Patent No.: US 10,749,274 B2
(45) Date of Patent: Aug. 18, 2020

(54) SEPARATE ANTENNA

(71) Applicant: Hewlett-Packard Development Company, L.P., Houston, TX (US)

(72) Inventors: Sung Oh, Palo Alto, CA (US); Tianji Zheng, San Diego, CA (US); Philip Wright, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 96 days.

(21) Appl. No.: 15/772,077

(22) PCT Filed: Feb. 19, 2016

(86) PCT No.: PCT/US2016/018702
§ 371 (c)(1),
(2) Date: Apr. 30, 2018

(87) PCT Pub. No.: WO2017/142555
PCT Pub. Date: Aug. 24, 2017

(65) Prior Publication Data
US 2019/0058263 A1 Feb. 21, 2019

(51) Int. Cl.
*H01Q 21/28* (2006.01)
*H01Q 1/24* (2006.01)
*H01Q 1/52* (2006.01)

(52) U.S. Cl.
CPC ..... *H01Q 21/28* (2013.01); *H01Q 1/243* (2013.01); *H01Q 1/521* (2013.01)

(58) Field of Classification Search
CPC ..... H01Q 21/28; H01Q 1/521; H01Q 1/243
See application file for complete search history.

(56) References Cited

U.S. PATENT DOCUMENTS 6,920,315 B1 * 7/2005 Wilcox ..... H01Q 1/246 343/913
7,525,502 B2 4/2009 Hui et al.
8,654,030 B1 * 2/2014 Mercer ..... H04W 88/06 343/876
8,952,859 B2 2/2015 Tan
9,007,267 B2 4/2015 Man et al.
2006/0017621 A1 * 1/2006 Okawara ..... H01Q 1/243 343/700 MS (Continued)

FOREIGN PATENT DOCUMENTS

CN 202196843 U 4/2012
CN 103929514 A 7/2014

(Continued)

OTHER PUBLICATIONS

Han, M et al, "Dual-band MIMO antenna using a symmetric slottec structure for 4G USB dongle application", Jul. 3-8, 2011.

*Primary Examiner* — Graham P Smith
(74) *Attorney, Agent, or Firm* — HPI Patent Department

(57) ABSTRACT

Example implementations relate to separate antennae. In one example, separate antennae can include an antenna system having a first antenna to receive and transmit signals in a first frequency band, a second antenna to receive signals in a second frequency band and transmit and receive signals in a third frequency band, and a third antenna to receive signals in a fourth frequency band, where each of the first antenna, the second antenna, and the third antenna are physically separate and distinct.

20 Claims, 3 Drawing Sheets

(56) References Cited

U.S. PATENT DOCUMENTS

| | | | |
|---|---|---|---|
| 2010/0220016 | A1 | 9/2010 | Nissinen et al. |
| 2012/0281597 | A1 | 11/2012 | Khlat et al. |
| 2013/0162486 | A1 | 6/2013 | Korva et al. |
| 2013/0217398 | A1 | 8/2013 | Winiecki et al. |
| 2013/0231064 | A1 | 9/2013 | Gudem et al. |
| 2013/0265912 | A1 | 10/2013 | Ikonen et al. |
| 2015/0109977 | A1 | 4/2015 | Loh |
| 2015/0200646 | A1 | 7/2015 | Peng et al. |

FOREIGN PATENT DOCUMENTS

| | | | |
|---|---|---|---|
| CN | 101529657 | B | 9/2014 |
| WO | WO-2016023309 | A1 | 2/2016 |

* cited by examiner

SEPARATE ANTENNA

BACKGROUND

Computing devices can include antennae to facilitate wireless communication. For example, in a two-antenna computing device, an antenna may be designated as a primary antenna to operates in all frequency bands of interest to the device, while the secondary antenna may be designated as a secondary antenna reserved for application of diversity functions to received signals.

DETAILED DESCRIPTION

As computing device specifications change, space allocation within computing devices may change. For example, mobile and/or portable computing devices (referred to generally herein as "computing devices") may become smaller, thinner, and/or lighter. Computing devices can include smartphones, handheld computers, personal digital assistants, carputers, wearable computers, laptops, tablet computers, laptop/tablet hybrids, etc.

Computing devices can include an antenna to send and/or receive signals. For example, an antenna can be used to facilitate web access, voice over IP, gaming, high-definition mobile television, video conferencing, etc. Some electronic devices employ a main transmission antenna and a diversity antenna. However, as computing devices become smaller, thinner, and/or lighter a main transmission antenna and a diversity antenna of an electronic device may be positioned comparatively closer to each other. An antenna may experience interference and/or may not perform as desired when positioned near and/or in contact with another antenna.

Accordingly, the disclosure is directed to methods, systems, and electronic devices employing separate antennae. For example, separate antennae as described herein can include an antenna system having a first antenna to receive and transmit signals in a first frequency band, a second antenna to receive signals in a second frequency band and transmit and receive signals in a third frequency band, and a third antenna to receive signals in a fourth frequency band. Notably, each of the first antenna, the second antenna, and the third antenna are physically separate and distinct. For example, the three antennae (first antenna, second antenna, and third antenna) can be positioned substantially at respective corners of an electronic device to create physical separation (i.e., distance) between each of the three antennae to promote antenna efficiency, provide desired antenna isolation, and result in a minimal envelop correlation coefficient.

Figure 1:
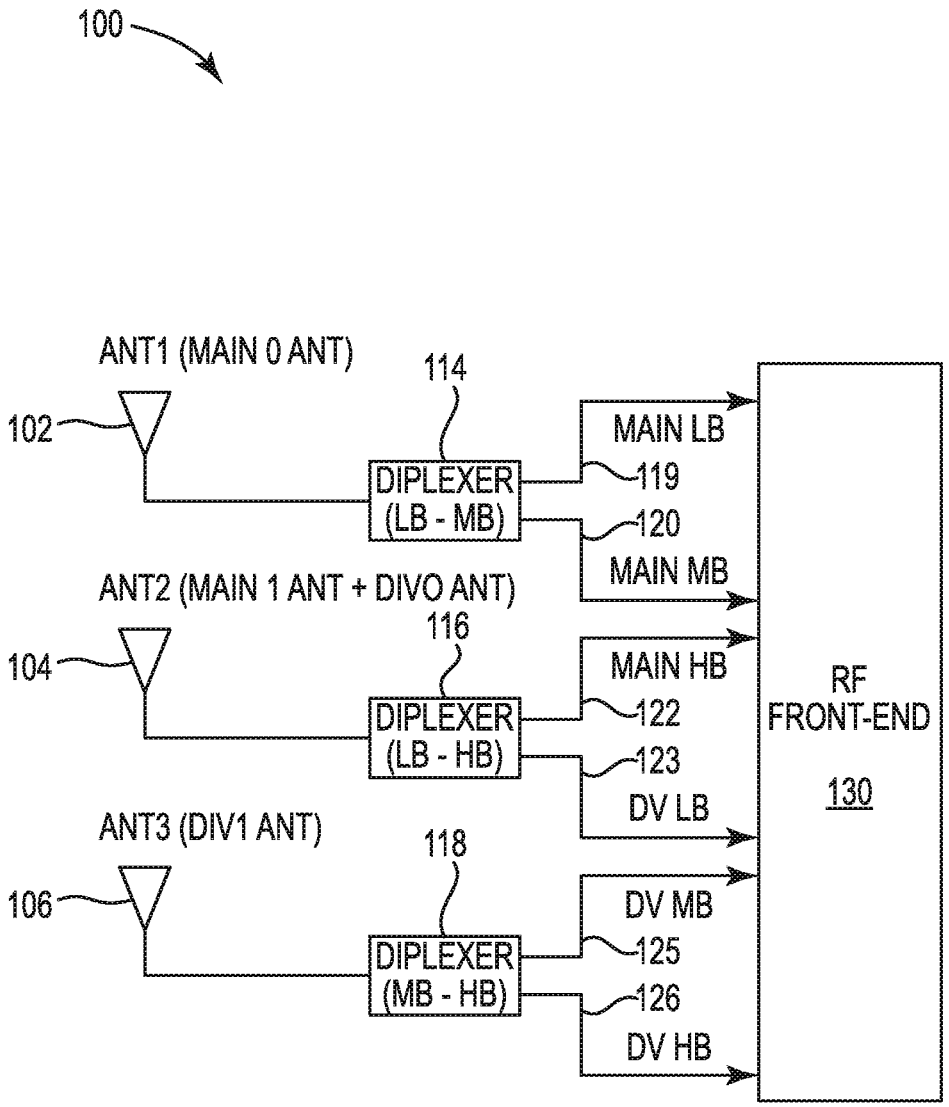
FIG. 1 illustrates a diagram of an example of a separate antennae system according to the disclosure.

FIG. 1 illustrates a diagram of an example of an antenna system 100 according to the disclosure. As illustrated in FIG. 1, the antenna system 100 can include a first antenna 102, a second antenna 104, and a third antenna 106.

The first antenna 102 can transmit and receive signals in a first frequency band. The first frequency band can be formed of a main low frequency band 119 and a main middle frequency band 120, as described herein. The first antenna 102 can be a physically contiguous antenna formed of a continuous conductive material and/or a combination of conductive materials, among other possibilities.

The second antenna 104 can receive signals in a second frequency band and transmit and receive signals in a third frequency band. The second frequency band can be formed of a diversity low frequency band 123 while the third frequency band can be formed of a main high frequency band 122, as described herein. The second antenna 104 can be a physically contiguous antenna formed of a continuous material and/or a combination of materials. For example, the second antenna 104 can be a formed of a single antenna arm, among other possibilities.

The third antenna 106 can receive signals in a fourth frequency band. The fourth frequency band can include a diversity middle frequency band 125 and a diversity high frequency band 126, as described herein. The third antenna 106 can be a physically contiguous antenna formed of a continuous conductive material and/or a combination of conductive materials.

The third antenna 106 can be physically smaller such that occupies a comparatively smaller volume of space than each of the first antenna 102 and the second antenna 104. For example, the third antenna 106 can be smaller than the first antenna 102 in at least one dimension such as having a length, width, and/or thickness that is comparatively less than the first antenna. Such a comparatively smaller size of the third antenna 106 can be due at least in part to the fact that the third antenna only supports diversity middle and high bands, while the first antenna 102 and the second antenna 104 support low frequency bands (i.e., the main low frequency band and diversity low frequency band).

As illustrated in FIG. 1, it is noted that each of the first antenna 102, the second antenna 104, and the third antenna 106 are separate and distinct. Put another way, each of the first antenna 102, the second antenna 104, and the third antenna 106 are not in physical contact with each other. By not being in physical contact with each other, the first antenna 102, the second antenna 104, and the third antenna 106 can be tuned independently from one another, operate at respective different frequency bands, create physical separation (i.e., distance) between each of the three antennae to promote antenna efficiency, provide desired antenna isolation, and result in a minimal envelop correlation coefficient.

In various examples, the first antenna 102 can be coupled to a first diplexer 114. Similarly, the second antenna 104 can be coupled to a second diplexer 116 and the third antenna can be coupled to a third diplexer 118. That is, three diplexers can be employed. As used herein, a "diplexer" refers to a passive device that implements frequency-domain multiplexing and/or frequency-division multiplexing. Although reference is made herein to a diplexer with two input ports and one output port the disclosure is not so limited. Rather a diplexer refers to a suitable device that implements frequency-domain and/or frequency-division multiplexing having a suitable number of inputs such as a triplexer, a quadplexer, or other suitable multiplexer to promote separate antenna.

As illustrated in FIG. 1, the first diplexer 114, the second diplexer 116, and the third diplexer 118 can be coupled to a radio frequency front-end (RF front-end) 130. The RF front-end 130 can include integrated circuits, amplifiers, and receivers, among other components. While not illustrated as such, in some examples, some or all of the diplexers (e.g., the third diplexer 118) can be included in the RF front-end 130. In any case, the first antenna 102, the second antenna 104, and the third antenna can be coupled via the RF front-end 130 or coupled via the RF front-end 130 and other components to form a main transmission antenna and a diversity antenna, as described herein.

In some examples, the first diplexer 114 can be coupled to a long term evolution (LTE) module (not shown). The LTE module can facilitate wireless communication between various computing devices. For instance, the LTE module can facilitate wireless communication between computing devices according to a WW-LTE or US-LTE standard. The LTE module can include instructions, a hardware processor, a transmitter, and a receiver, among other components to promote wireless communications to and/or from an electronic device. For example, the hardware processor can control how (e.g., which antenna) and/or when the antenna system transmits and/or receives signals, among other possibilities.

The main low frequency band 119 can each include frequencies in a range from 699 megahertz (MHz) to 960 MHz. Similarly, the diversity low frequency band 123 can include frequencies in a range from 729 MHz to 960 MHz.

The main middle frequency band 120 can include frequencies from 1710 MHz to 2160 MHz. Similarly, the diversity middle frequency band 125 can include frequencies from 1805 MHz to 2160 MHz.

The diversity high frequency band 126 can include frequencies in a range from 2350 MHz to 2690 MHz. Similarly, the main high frequency band 122 can include frequencies in a range from 2305 MHz to 2690 MHz. However, the disclosure is not so limited. Rather, main low frequency band 119, the diversity low frequency band 123, the main middle frequency band 120, the diversity middle frequency band 125, the diversity high frequency band 126, and/or the main high frequency band 122 can be varied to include different respective frequencies depending upon a desired application and/or to otherwise promote separate antennae.

Figure 2:
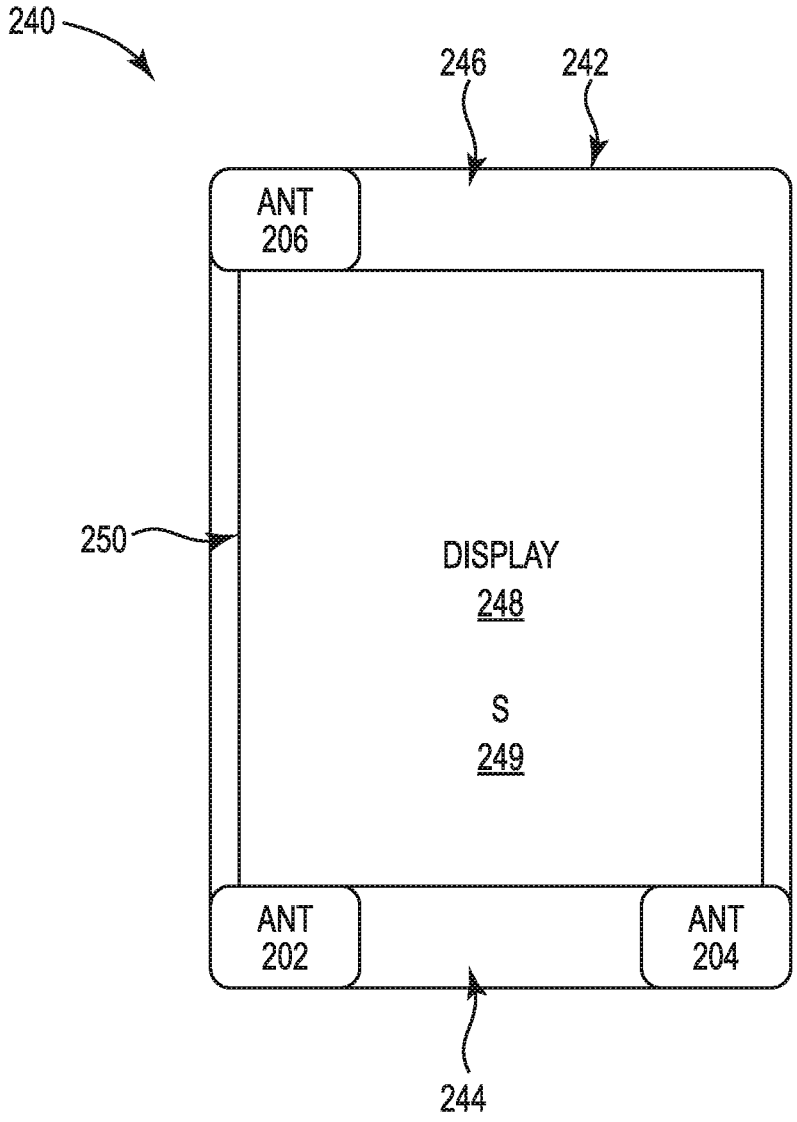
FIG. 2 illustrates a diagram of an example of a computing device including a separate antennae system according to the disclosure.

FIG. 2 illustrates a diagram of an example of a computing device 240 including a separate antennae system according to the disclosure. As mentioned, the computing devices can include a smartphone, handheld computer, personal digital assistant, carputer, wearable computer, laptop, tablet computer, and/or laptop/tablet hybrids, etc. The computing device 240 can include a housing 242, a first antenna 202, a second antenna 204, and a third antenna 206. The first antenna 202, the second antenna 204, the third antenna 206 are analogous to the first antenna 102, a second antenna 104, and a third antenna 106, respectively.

The housing 242 refers to an outer body of the computing device 240. The housing 242 can be formed of metal, plastic, and/or various other materials. The housing 242 can include a first end 244 (e.g., a bottom end) and a second end 246 (e.g., a top end). In various examples, the first antenna 202 and the second antenna 204 can be at the first end 244 of the housing 242. For example, as shown in FIG. 2, the first antenna 202 can be positioned at a lower left corner of the computing device 240 while the second antenna can be positioned at a lower right corner of the electronic device.

However, the first antennae 202 and/or the second antenna 204 can be positioned in various other locations along the first end 244. For example, the first antenna can be positioned at the lower right corner (e.g., when the second antenna 204 is positioned elsewhere) and/or at a center of the first end 244, among other possibilities. In some examples, the first end 244 can include a microphone or other receiver (not shown) to received audio communication such as those provided be a user of the electronic device to the electronic device while the second end 246 can include a speaker (not shown) or other sound emitting device to convey audio information to an end user of the computing device 240.

In various examples, the third antenna 206 can be positioned at the second end 246 of the electronic device 240. For example, the third antenna 206 can be positioned substantially at an upper left corner as illustrated in FIG. 2. In such examples, the third antenna 206 is comparatively further in distance from the second antenna 204 than the first antenna 202 as is illustrated in FIG. 2.

As illustrated in FIG. 2, the first end 244 is opposite the second end 246. However, while the first end 244 is shown as a 'bottom' end of the electronic device 240 and the second end 246 is shown as a 'top' end of the electronic device 240 to disclosure is not so limited. Rather, in some examples, the first end 244 can be a 'side' (e.g., a left side) of the electronic device 240 and the second end 246 can be an opposite 'side" (e.g., a right side) of the electronic device 240.

However, the position of the third antenna 206 can vary along the second end 246 of the device and/or relative to the first antenna 202 and/or the second antenna 204. For example, the third antenna 206, in some examples, can be positioned substantially at an upper right corner of the computing device 240. In such examples, the third antenna 206 is comparatively further in distance from the first antenna 202 than the second antenna 204 when the first antennae 202 and the second antenna are in the positions illustrated in FIG. 2.

In any case, each of the first antenna 202, the second antenna 204, and the third antenna 206 are separate and distinct antenna that are positioned substantially at respective corners of the computing device 240 to provide promote high antenna efficiency, high antenna isolation, and low envelop correlation coefficient in contrast to other approaches that do not employ such separate and distinct antenna positioned at respective corners of an electronic device.

In various examples, first antenna 202 and the second antenna 204 together form a main transmission antenna to wirelessly transmit and receive signals in a main frequency band formed of the first frequency band (i.e., the main low frequency band and the main middle frequency band) and the third frequency band (i.e., the main high frequency band). Put another way, while the first antenna 202 and the second antenna 204 are physically separate and distinct they operate in conjunction to provide the computing device 240 with full transmission and receiving capabilities across the main frequency band. For instance, the main transmission antenna can wirelessly transmit and/or receive signals in accordance with a WW-LTE or US-LTE standard.

In some examples, the main transmission antenna is the only transmission antennae of the computing device. In this way, only the first antenna 202 and the second antenna 204 are used for main transmission purposes.

In various examples, the third antenna 206 and the second antenna 204 together form a diversity antenna to receive signals in a diversity frequency band formed of the second frequency band (i.e., the diversity low frequency band) and the fourth frequency band (i.e., the diversity middle frequency band and the diversity high frequency band). Put another way, while the third antenna 206 and the second antenna 204 are physically separate and distinct they operate in conjunction to provide the computing device 240 with full diversity receiving capabilities across the diversity band.

In some examples, the diversity antenna is the only antenna in the computing device that performs diversity reception. In this way, only the third antenna 206 and the second antenna 204 are used for diversity receiving purposes.

It is noted that some (i.e., a portion of a particular antenna), all, or none, of antenna may be visible to an end user of the electronic device. That is, the first antenna 202, second antenna 204, and third antenna 206 are illustrated as visible in FIG. 2 for ease of illustration and discussion but the computing device 240 and separate antennae as described herein are not so limited.

Instead, in various examples, each of the first antenna 202, the second antenna 204, and the third antenna 206 are encompassed in an internal volume of the electronic device formed at least in part by the housing 242 such that none of the first antenna 202, the second antenna 204, and the third antenna 206 are visible to an end user (i.e., consumer) of the computing device 240. For instance, the first antenna 202, the second antenna 204, and the third antenna 206 can be provided on a printed circuit board included in the computing device 240, among other possibilities. In some examples, the first antenna 202, the second antenna 204, and the third antenna 206 can be positioned in the bezel 250 of the computing device 240, as is illustrated in FIG. 2.

An electronic display 248 of the computing device 240 extends entirely and/or at least substantially from the first end 244 to the second end 246 of the computing device 240 to display information (e.g., "S" 249), among other possible information) and/or receive information input by a user of the computing device 240. In some examples, the computing device 240 can include a bezel 250 that surrounds a periphery of an electronic display 248. However the disclosure is not so limited. Rather, in various examples, the electronic display 248 can extend entirely across of a length and/or width of a face of the electronic device.

For ease of illustration not all components of the computing device 240 are illustrated. That is, the computing device 240 includes additional components other than those illustrated in FIG. 2. For example, diplexers, a RF front end, processors, ICs, memory, transmitters, and/or receivers, among other components, can be included in the computing device 240.

Figure 3:
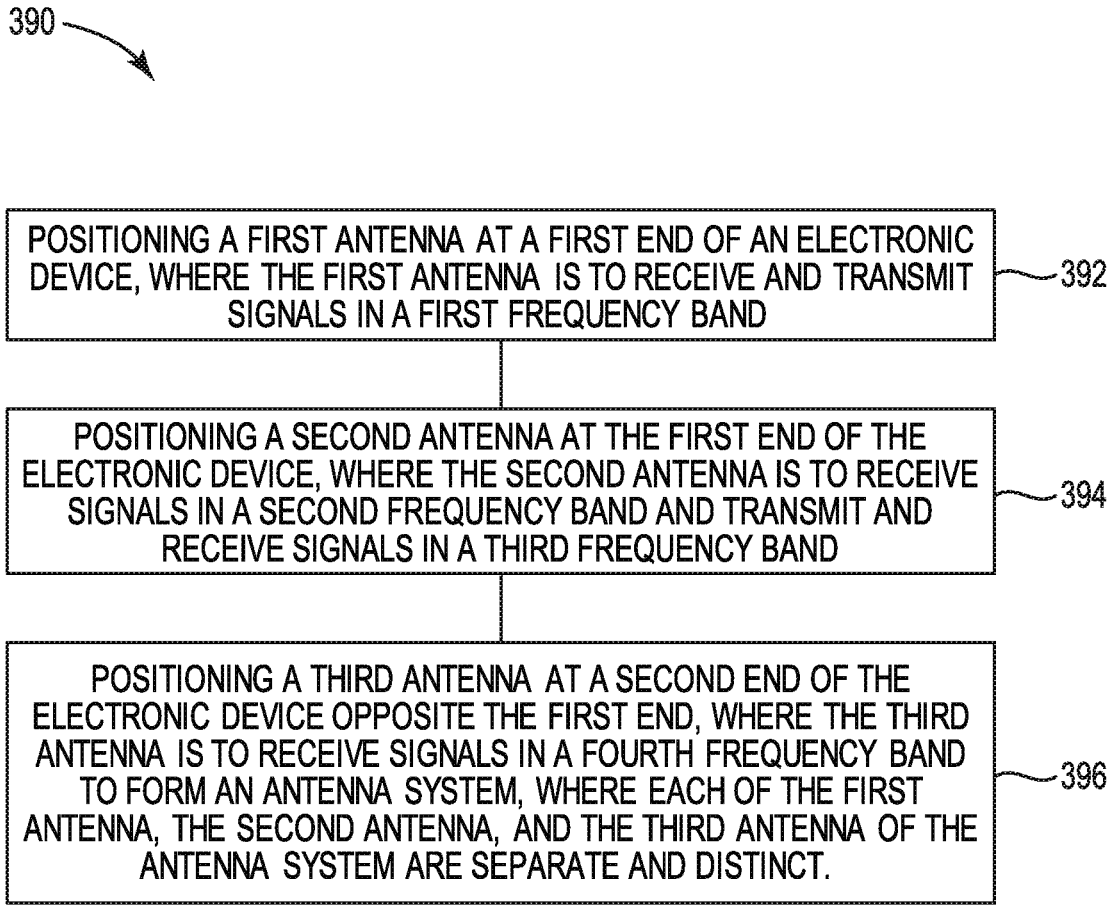
FIG. 3 illustrates a flow diagram of an example of a method of formation of a separate antennae system according to the disclosure.

FIG. 3 illustrates a flow diagram of an example of a method 390 of formation of a separate antennae system according to the disclosure. As illustrated at 392, the method 390 can include positioning a first antenna at a first end of an electronic device. As used herein, positioning can include manufacture of and/or otherwise procuring the first antenna. As mentioned, the first antenna is to receive and transmit signals in a first frequency band.

The method 390 can include positioning a second antenna at the first end of the electronic device, as illustrated at 394. As mentioned, the second antenna is to receive signals in a second frequency band and transmit and receive signals in a third frequency band.

As illustrated at 396, the method 390 can include positioning a third antenna at a second end of the electronic device opposite the first end form an antenna system. As mentioned, the third antenna is to receive signals in a fourth frequency band to form an antenna system. Notably, each of the first antenna, the second antenna, and the third antenna of the antenna system are physically separate and distinct.

In some examples, the method 390 can include coupling the first antenna to a first diplexer, coupling the second antenna to a second diplexer, and coupling the third antenna to a third diplexer. In various examples, each the first antenna, the second antenna, the third antenna, the first diplexer, the second diplexer, and the third diplexer can be disposed on a PCB (e.g., a single PCB). However, other configurations that promote separate antennae, as described herein, are possible.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure.

The figures herein follow a numbering convention in which the first digit corresponds to the drawing figure number and the remaining digits identify an element or component in the drawing. For example, reference numeral 110 may refer to element "10" in FIG. 1 and an analogous element may be identified by reference numeral 210 in FIG. 2. Elements shown in the various figures herein can be added, exchanged, and/or eliminated so as to provide a number of additional examples of the disclosure. In addition, the proportion and the relative scale of the elements provided in the figures are intended to illustrate the examples of the disclosure, and should not be taken in a limiting sense.

As used herein, "a number of" an element and/or feature can refer to one or more of such elements and/or features. It is understood that when an element is referred to as being "on," "connected to", "coupled to", or "coupled with" another element, it can be directly on, connected to, or coupled with the other element or intervening elements may be present. As used herein, "substantially" refers to a characteristic that is close enough to the absolute characteristic to achieve the same functionality (e.g., having three respective antenna (first antenna, second antenna, and third antenna) each positioned substantially at respective corners of an electronic device to create physical separation (i.e., distance) between each of the three antenna to achieve high antenna isolation).

What is claimed:

1. An antenna system for use with a computing device having a housing, comprising:

a first antenna to receive and transmit signals at frequencies in a first frequency range between 699 megahertz (MHz) and 960 MHz;

a second antenna to receive signals at frequencies in a second frequency range and transmit and receive signals at frequencies in a third frequency range between 2305 MHz and 2690 MHz, wherein the second frequency range is different from the third frequency range; and a third antenna to receive signals at frequencies in a fourth frequency range that is different from each of the first frequency range, the second frequency range, and the third frequency range, wherein the first antenna, the second antenna, and the third antenna are physically separate and distinct in a specified physical arrangement, the specified physical arrangement comprising:

the first antenna at a first position corresponding to a first end of the housing, the second antenna at a second position corresponding to the first end and at a first corner of the housing, and the third antenna at a third position corresponding to a second end and a second corner of the housing, the second end of the housing being opposite the first end of the housing.

2. The antenna system of claim 1, wherein the second antenna comprises a physically contiguous antenna to receive signals in the second frequency range and transmit and receive signals in the third frequency range.

3. The antenna system of claim 1, wherein the first frequency range comprises a main low frequency band and a main middle frequency band, and wherein the third frequency range comprises a main high frequency band, wherein the main low frequency band comprises the frequencies between 699 MHz and 960 MHz, and the main middle frequency band comprises frequencies greater than the main low frequency band.

4. A computing device, comprising:

a housing; and an antenna system comprising:

a first antenna at a first end of the housing, wherein the first antenna is to receive and transmit signals at frequencies in a first frequency range between 699 megahertz (MHz) and 960 MHz;

a second antenna at the first end and at a first corner of the housing, wherein the second antenna is to receive signals at frequencies in a second frequency range and transmit and receive signals at frequencies in a third frequency range between 2305 MHz and 2690 MHz, wherein the second frequency range is different from the third frequency range; and a third antenna at a second end of the housing opposite the first end of the housing, wherein the third antenna is at a second corner of the housing, and wherein the third antenna is to receive signals at frequencies in a fourth frequency range that is different from each of the first frequency range, the second frequency range, and the third frequency range, wherein the first antenna, the second antenna, and the third antenna are physically separate and distinct.

5. The computing device of claim 4, wherein the first antenna and the second antenna together form a main transmission antenna to wirelessly transmit and receive signals in a main frequency band formed of the first frequency range and another frequency range different from the first frequency range.

6. The computing device of claim 5, wherein the main transmission antenna is to wirelessly transmit and receive in accordance with a WW-LTE or US-LTE standard.

7. The computing device of claim 6, wherein the main transmission antenna is the only transmission antenna of the computing device that performs transmission and reception in accordance with the WW-LTE or US-LTE standard.

8. The computing device of claim 5, wherein the fourth frequency range comprises a diversity high frequency band and a diversity middle frequency band, and wherein the second frequency range comprises a diversity low frequency band that is different from the third frequency range comprising frequencies at which the second antenna is able to transmit and receive signals.

9. The computing device of claim 8, wherein the third antenna and the second antenna together form a diversity antenna to receive signals in a diversity frequency band formed of the diversity low frequency band, the diversity middle frequency band, and the diversity high frequency band.

10. The computing device of claim 9, wherein the diversity antenna is the only antenna in the computing device that performs diversity reception.

11. The computing device of claim 9, wherein the diversity low frequency band is from 729 MHz to 960 MHz, wherein the diversity middle frequency band is from 1805 MHz to 2160 MHz, and wherein the diversity high frequency band is from 2350 MHz to 2690 MHz.

12. The computing device of claim 4, wherein the first antenna, the second antenna, and the third antenna are not in physical contact.

13. The computing device of claim 4, wherein the computing device comprises a mobile phone.

14. A method of manufacture, comprising:

positioning a first antenna at a first end of a housing of an electronic device, wherein the first antenna is to receive and transmit signals at frequencies in a first frequency range between 699 megahertz (MHz) and 960 MHz;

positioning a second antenna at the first end and a first corner of the housing, wherein the second antenna is to receive signals at frequencies in a second frequency range and transmit and receive signals at frequencies in a third frequency range between 2305 MHz and 2690 MHz, wherein the second frequency range is different from the third frequency range; and positioning a third antenna at a second end of the housing opposite the first end to form an antenna system that includes the first antenna, the second antenna, and the third antenna, wherein the third antenna is at a second corner of the housing, and wherein the third antenna is to receive signals at frequencies in a fourth frequency range that is different from each of the first frequency range, the second frequency range, and the third frequency range, wherein the first antenna, the second antenna, and the third antenna of the antenna system are physically separate and distinct.

15. The method of claim 14, further comprising coupling the first antenna to a first diplexer, coupling the second antenna to a second diplexer, and coupling the third antenna to a third diplexer.

16. The computing device of claim 4, wherein the first antenna is at a third corner of the housing, the first corner being one on side of the first end, and the third corner being on another side of the first end.

17. The computing device of claim 16, wherein the third corner is on a same side of the housing as the second corner, and the first corner is on an opposite side of the housing with respect to the third corner and the second corner.

18. The computing device of claim 16, wherein the third antenna is comparatively further in distance from the second antenna than the first antenna.

19. The method of claim 14, wherein the first antenna is at a third corner of the housing, the first corner being one on side of the first end, and the third corner being on another side of the first end.

20. The method of claim 19, wherein the third corner is on a same side of the housing as the second corner, and the first corner is on an opposite side of the housing with respect to the third corner and the second corner.

* * * * *